US008043166B2

(12) United States Patent
Cackett et al.

(10) Patent No.: US 8,043,166 B2
(45) **Date of Patent: *Oct. 25, 2011**

(54) DRIVER WITH DEEP AFT CAVITY

(75) Inventors: Matthew T. Cackett, San Diego, CA (US); Alan Hocknell, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/834,776

(22) Filed: Jul. 12, 2010

(65) Prior Publication Data

US 2010/0273573 A1 Oct. 28, 2010

Related U.S. Application Data

(63) Continuation of application No. 12/332,551, filed on Dec. 11, 2008, now Pat. No. 7,753,809.

(60) Provisional application No. 61/014,886, filed on Dec. 19, 2007.

(51) Int. Cl.
*A63B 53/04* (2006.01)

(52) U.S. Cl. ..... 473/329; 473/345; 473/349; 473/350

(58) Field of Classification Search ..... 473/324–350, 473/287–292, 256; D21/732–750
See application file for complete search history.

(56) References Cited

U.S. PATENT DOCUMENTS 1,139,985 A * 5/1915 Legh ..... 473/350
1,167,387 A 1/1916 Daniel
1,638,916 A 8/1927 Butchart
1,671,956 A * 5/1928 Sime ..... 473/329
1,780,625 A 11/1930 Mattern
2,087,685 A 7/1937 Hackney
2,750,194 A 6/1956 Clark
3,692,306 A 9/1972 Glover
3,814,437 A 6/1974 Winquist
3,897,066 A 7/1975 Belmont
3,937,474 A 2/1976 Jepson et al.
3,966,210 A * 6/1976 Rozmus ..... 473/341
D240,948 S * 8/1976 Redoutey ..... D21/747
3,975,023 A 8/1976 Inamori
3,989,248 A 11/1976 Campau
4,021,047 A 5/1977 Mader
4,398,965 A 8/1983 Campau
4,568,088 A * 2/1986 Kurahashi ..... 473/343
4,872,685 A 10/1989 Sun
4,877,249 A 10/1989 Thompson
4,919,430 A 4/1990 Antonious
5,060,949 A * 10/1991 Brill ..... 473/328
5,078,400 A * 1/1992 Desbiolles et al. ..... 473/349
5,106,094 A 4/1992 Desbiolles et al.
D326,130 S * 5/1992 Chorne ..... D21/733
5,186,465 A * 2/1993 Chorne ..... 473/350
5,193,811 A 3/1993 Okumoto et al.
5,282,624 A 2/1994 Viste
5,346,216 A 9/1994 Aizawa (Continued)

*Primary Examiner* — Sebastiano Passaniti

(74) *Attorney, Agent, or Firm* — Michael A. Catania; Rebecca Hanovice; Sonia Lari

(57) ABSTRACT

A golf club head with a deep aft cavity is disclosed herein. The body has a striking plate wall, a crown section, a sole section and a rear wall. An area of interest preferably has less than 12% of the mass of the golf club head. The golf club head preferably is a driver.

10 Claims, 13 Drawing Sheets

U.S. PATENT DOCUMENTS

D354,782 S * 1/1995 Gonzalez, Jr. ..... D21/752
5,377,986 A 1/1995 Viollaz et al.
5,401,021 A 3/1995 Allen
5,410,798 A 5/1995 Lo
5,425,538 A 6/1995 Vincent et al.
5,464,210 A 11/1995 Davis et al.
5,474,296 A 12/1995 Schmidt et al.
5,499,814 A 3/1996 Lu
5,516,107 A 5/1996 Okumoto et al.
5,547,427 A 8/1996 Rigal et al.
5,570,886 A 11/1996 Rigal et al.
5,595,552 A 1/1997 Wright et al.
5,624,331 A 4/1997 Lo et al.
5,643,108 A 7/1997 Cheng
5,743,813 A 4/1998 Chen et al.
5,830,084 A 11/1998 Kosmatka
5,836,830 A 11/1998 Onuki et al.
5,863,261 A 1/1999 Eggiman
5,888,148 A 3/1999 Allen
5,971,868 A 10/1999 Kosmatka
6,048,278 A 4/2000 Meyer et al.
6,146,571 A 11/2000 Vincent et al.
6,149,534 A 11/2000 Peters et al.
6,152,833 A 11/2000 Werner et al.
6,165,081 A 12/2000 Chou
6,310,185 B1 10/2001 Wallace et al.
6,319,150 B1 * 11/2001 Werner et al. ..... 473/349
6,332,848 B1 12/2001 Long et al.
6,348,015 B1 2/2002 Kosmatka
6,354,962 B1 3/2002 Galloway et al.
6,390,933 B1 5/2002 Galloway et al.
6,406,381 B2 6/2002 Murphy et al.
6,471,604 B2 10/2002 Hocknell et al.
6,491,592 B2 12/2002 Cackett et al.
6,565,452 B2 5/2003 Helmstetter
6,582,323 B2 6/2003 Soracco et al.
6,602,149 B1 8/2003 Jacobson
6,758,763 B2 7/2004 Murphy et al.
6,800,039 B1 10/2004 Tseng
6,890,267 B2 * 5/2005 Mahaffey et al. ..... 473/256
6,926,618 B2 8/2005 Sanchez et al.
6,942,581 B2 * 9/2005 Kim et al. ..... 473/345
6,960,142 B2 11/2005 Bissonnette et al.
6,964,617 B2 * 11/2005 Williams ..... 473/245
7,059,973 B2 * 6/2006 Erickson et al. ..... 473/345
7,101,289 B2 9/2006 Gibbs et al.
7,147,573 B2 * 12/2006 DiMarco ..... 473/324
7,163,468 B2 * 1/2007 Gibbs et al. ..... 473/329
7,166,038 B2 * 1/2007 Williams et al. ..... 473/329
7,169,060 B2 * 1/2007 Stevens et al. ..... 473/329
7,255,653 B2 * 8/2007 Saso ..... 473/345
7,258,626 B2 * 8/2007 Gibbs et al. ..... 473/329
7,258,630 B2 * 8/2007 Erickson et al. ..... 473/345
7,278,927 B2 * 10/2007 Gibbs et al. ..... 473/329
7,291,075 B2 * 11/2007 Williams et al. ..... 473/329
7,413,520 B1 * 8/2008 Hocknell et al. ..... 473/345
7,422,528 B2 * 9/2008 Gibbs et al. ..... 473/329
7,462,109 B2 * 12/2008 Erickson et al. ..... 473/332
7,488,261 B2 * 2/2009 Cackett et al. ..... 473/300
7,520,820 B2 * 4/2009 Dimarco ..... 473/334
7,578,756 B2 * 8/2009 Erickson et al. ..... 473/342
7,717,803 B2 * 5/2010 DiMarco ..... 473/334
7,753,809 B2 * 7/2010 Cackett et al. ..... 473/345
2001/0001093 A1 5/2001 Murphy et al.
2001/0001302 A1 5/2001 Murphy et al.
2002/0187853 A1 12/2002 Beach et al.
2003/0153401 A1 8/2003 Helmstetter et al.
2003/0171160 A1 9/2003 Murphy et al.

* cited by examiner

DRIVER WITH DEEP AFT CAVITY

CROSS REFERENCES TO RELATED APPLICATIONS

The present application is a continuation application of U.S. patent application Ser. No. 12/332,551, filed on Dec. 11, 2008, which claims priority to U.S. Provisional Patent Application No. 61/014,886, filed on Dec. 19, 2007.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head with high moments of inertia. More specifically, the present invention relates to a golf club head with a high moment of inertia achieved through the use of a deep aft cavity.

2. Description of the Related Art

Golf club companies have been increasing inertia properties of drivers to increase their performance particularly off center ball speed. The conventional shape of a driver limits the inertial values for a given head weight that can be attained within the dimension rules set by the USGA. Designs such as the FT-i® Driver from Callaway Golf Company have used non traditional shapes to increase inertia but the volume rule limits the potential efficiency of the location of discretionary weight placement. Designs that make use of light sections or light material to increase the amount of discretionary mass usually do not or can not (because of shape inefficiencies) place the discretionary mass in locations that provide the highest inertial benefit. Callaway Golf's FUSION® technology allows weight to be placed for high inertia by reducing the amount of weight tied up in the body of the club where inertia value is low.

The Rules of Golf, established and interpreted by the United States Golf Association ("USGA") and The Royal and Ancient Golf Club of Saint Andrews, set forth certain requirements for a golf club head. The requirements for a golf club head are found in Rule 4 and Appendix II. A complete description of the Rules of Golf are available on the USGA web page at www.usga.org. One such limitation is the volume of the golf club head.

Existing driver heads are generally bulbous shaped bodies with a distinct striking face, crown and sole surfaces that are blended into a contiguous enclosed volume. These existing head shapes may be pear shaped, square, triangular or the like when viewed from above. Further, the shapes generally have a continuous perimeter outline consisting of face, heel, toe and aft edges. These heads can achieve reasonably high levels of inertia (Iyy and Izz) by placing discretionary weighting in the aft corners or aft center of these shapes. However, these shapes have a common deficiency in that they all have shell mass, area and volume in the center and back center regions (shaded area in views below) of the head that is relatively inefficient from an inertial standpoint.

Some drivers have been designed to address this issue by using aft concavities to reduce the amount of shell mass in this inefficient location. However, these drivers had other shortcomings. The Nassau driver, for instance, had a shallow face-aft dimension and little aft volume for aft weighting; it also had a low over-all head volume, both contributed to relatively low inertia. The hollow point driver was deeper and had more aft volume for weighting but was still relatively small volume. Further, it had an "extreme concavity" rendering the design visually unappealing and non-conforming to the USGA and R&A rules of golf.

BRIEF SUMMARY OF THE INVENTION

One aspect of the present invention is a golf club head. The golf club head includes body having a front wall, a crown wall, a sole wall, a heel wall, a rear wall, and a toe wall. The body defines a hollow interior. The golf club head has a volume ranging from 450 cubic centimeters to 475 cubic centimeters. The golf club head has a mass ranging from 180 grams to 225 grams.

The present invention seeks to increase the amount of inertia achievable for a given head volume compared to conventional shapes and compared to prior un-conventional shapes by more effectively distributing the enclosed volume into an advantageous shape. Inertia levels of Izz>5500 and Iyy>4000 are anticipated at a volume of 460 cc. It is sought to reduce the amount of shell mass in the center and back center regions of the head shape, which constitutes approximately 45% of the inscribed area, to less than 15% of the total club head mass. This will enable more mass to be positioned in the face and aft corners which will enhance inertia and as a result, consistency of ball flight and distance.

There are difficulties that must be overcome in designing high volume driver with a deep aft cavity.

First, structural integrity—a driver shape with deep aft concavity is subject to higher stresses than is a bulbous shaped head. The heel and toe sides are essentially parallel cantilevers that must be using advanced FEA stress analysis with judicious selection of shell material (titanium alloy, or more preferably, carbon composite laminate). Without advanced design methods the weight advantages of a deep aft concavity shape might be lost in reinforcing the parallel cantilevers.

Second, sound—a driver shape with deep aft concavity is likely to sound unpleasant to the user unless advanced FEA modal analysis is employed to refine the shape and local stiffness of the parallel cantilevers.

Third, shape—in order to be conforming to the rules of golf the dual cantilevers must appear as separate portions of a single overall shape such that there is a visual continuity between them.

The primary advantage is that mass that would ordinarily be tied up in the center and back center of the shell is minimized and redistributed to the rear quadrants of the shape, resulting in increased inertia (Iyy, Izz). Alternately, the extra mass can be redistributed to purposely affect the cg location to manipulate ball flight.

This invention has a small amount of mass in center and center back regions (area of interest) as view from above (at address, 60 degrees lie, square face).

Yet another aspect of the present invention is a large face area where in the face has a width of five inches and a height of two point eight (2.8) inches, for golf club head less than 470 cc.

Yet another aspect of the present invention is a golf club head with a moment of inertia, Izz about the center of gravity greater than 5000 g-cm$^2$.

Yet another aspect of the present invention is a golf club head with a moment of inertia, Iyy about the center of gravity greater than 4000 g-cm$^2$.

Yet another aspect of the present invention is a golf club head with a large ratio of Izz/Mass.

Yet another aspect of the present invention is a golf club head with a large ratio of Iyy/Mass.

Yet another aspect of the present invention is a golf club head with a large ratio of Izz/Mass.

Yet another aspect of the present invention is a golf club head with a large ratio of Iyy/Mass.

Yet another aspect of the present invention is a golf club head with a large ratio of (Izz+Iyy)/Ixx.

Yet another aspect of the present invention is a golf club head with a large ratio of (Izz+Iyy)/Mass.

Yet another aspect of the present invention is a golf club head with a large ratio of Izz+Iyy) volume.

Yet another aspect of the present invention is a golf club head with less than 15% of the mass of the golf club head in the area of interest.

Yet another aspect of the present invention is a golf club head with less than 12% of the mass of the golf club head in the area of interest.

Yet another aspect of the present invention is a golf club head with a depth of an aft concavity less than 3.75 inches and more than 1 inch, and also an angle of the aft concavity greater than 0 degrees.

Yet another aspect of the present invention is a golf club head with an area of interior "massless" zone Yet another aspect of the present invention is a golf club head with a unique volume profile from front to back.

Yet another aspect of the present invention is a golf club head with a unique area profile from heel to toe.

Yet another aspect of the present invention is a golf club head with a unique Volume profile from heel to toe.

Yet another aspect of the present invention is a driver shape having a deep concavity in the aft edge resulting in increased inertia relative to the head mass and/or enclosed head volume.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
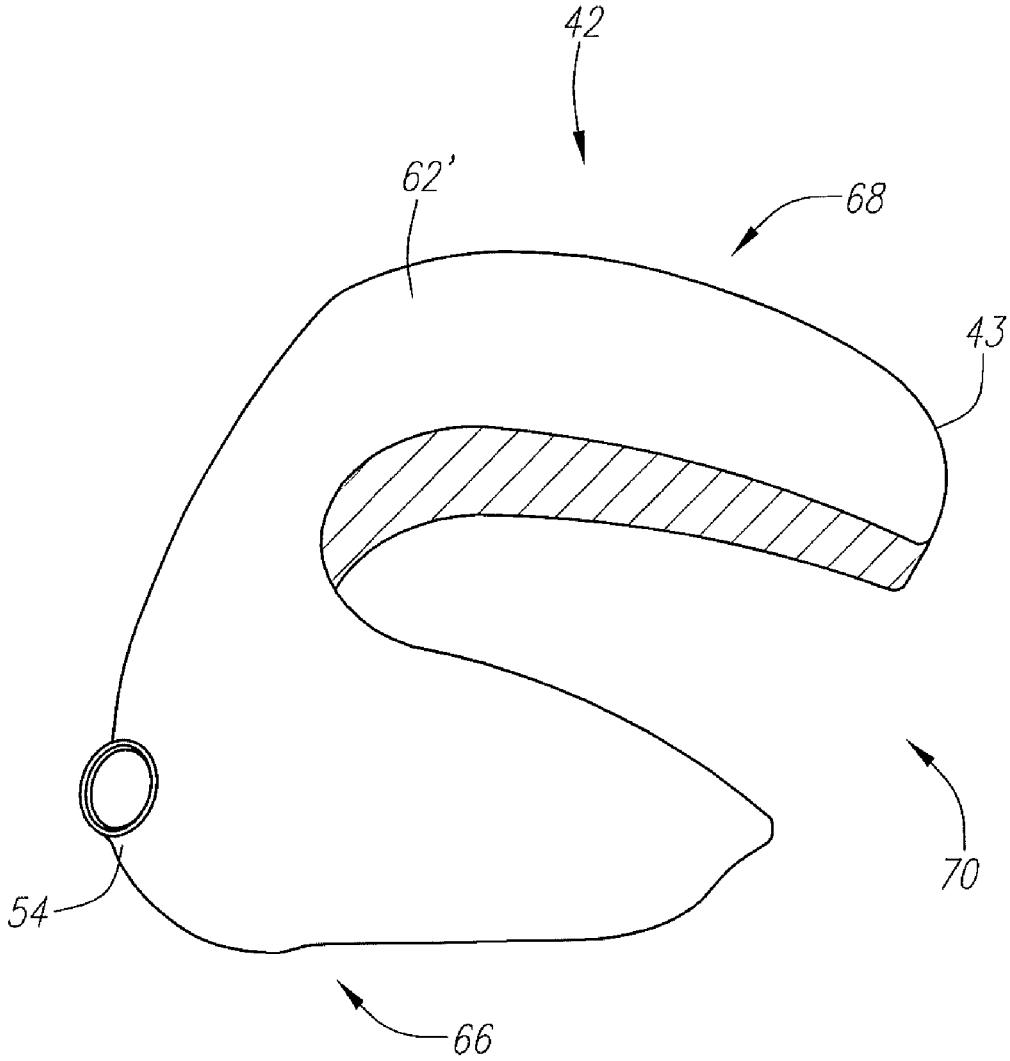
FIG. 1 is a rear perspective view of a golf club head of the present invention illustrating the deep aft-cavity.

The present invention is generally directed at a golf club head a deep aft cavity that has a relatively high moment of inertia Izz about the center of gravity of the golf club head. A general embodiment of the club head is illustrated in the Figures. Those skilled in the pertinent art will recognize from this disclosure that other embodiments of the golf club head of the present invention are possible without departing from the scope and spirit of the present invention.

As shown in the figures, a golf club head of the present invention is generally designated 42. Preferably, a body 43 of the golf club head has a crown 62, a sole 64, a ribbon 90, and a striking plate 72, all of which preferably define a hollow interior. The golf club head 42 has a heel end 66, a toe end 68 and an aft cavity 70.

The golf club head 42, when designed as a driver, preferably has a volume from 300 cubic centimeters to 600 cubic centimeters, more preferably from 400 cubic centimeters to 500 cubic centimeters, and most preferably from 420 cubic centimeters to 475 cubic centimeters, even more preferably from 450 cubic centimeters to 475 cubic centimeters, with a most preferred volume of 460 cubic centimeters.

The golf club head 42, when designed as a driver, preferably has a mass no more than 225 grams, and most preferably a mass of 180 to 215 grams.

Figure 1A:
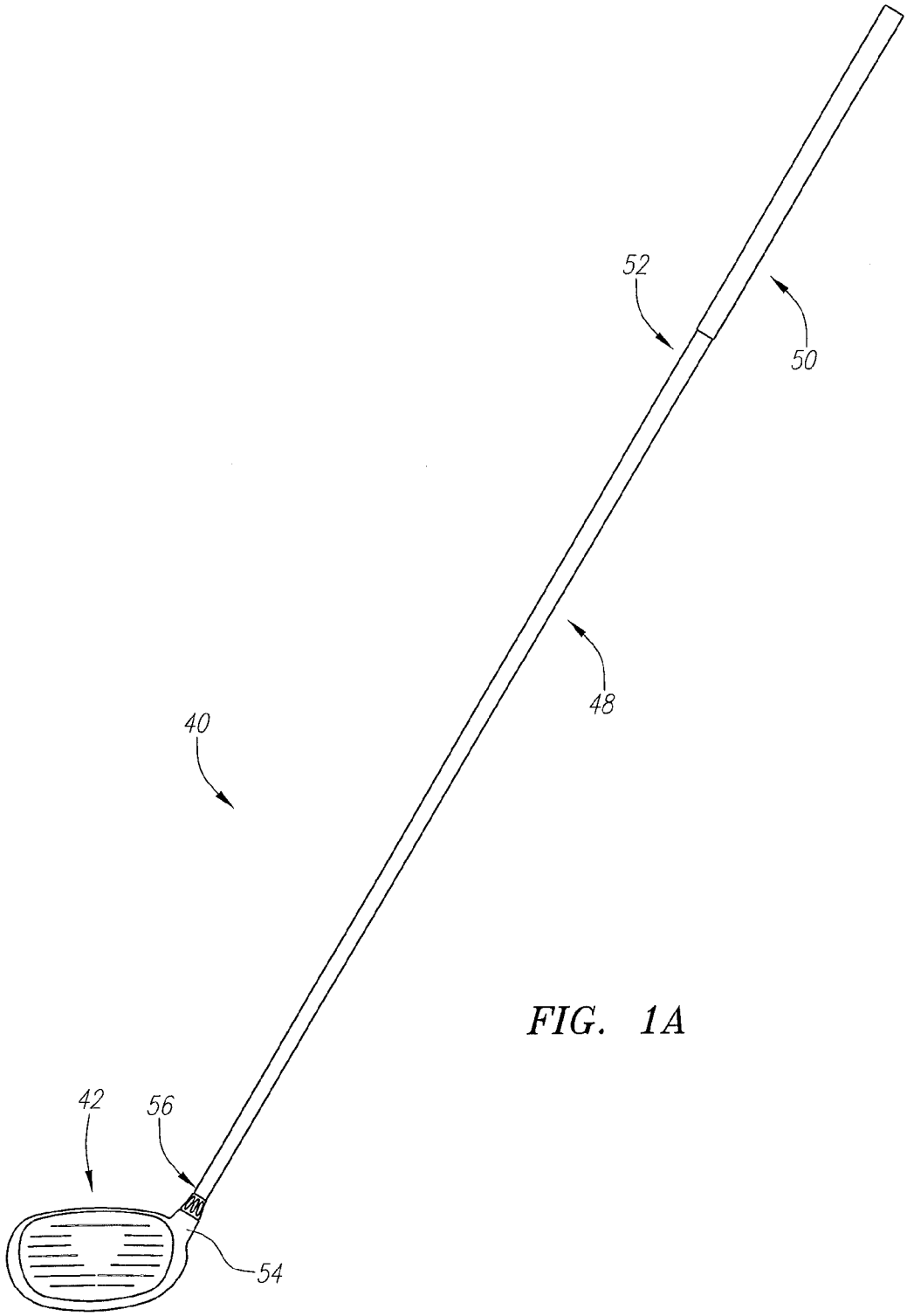
FIG. 1A is a front view of a golf club of the present invention.
Figure 2:
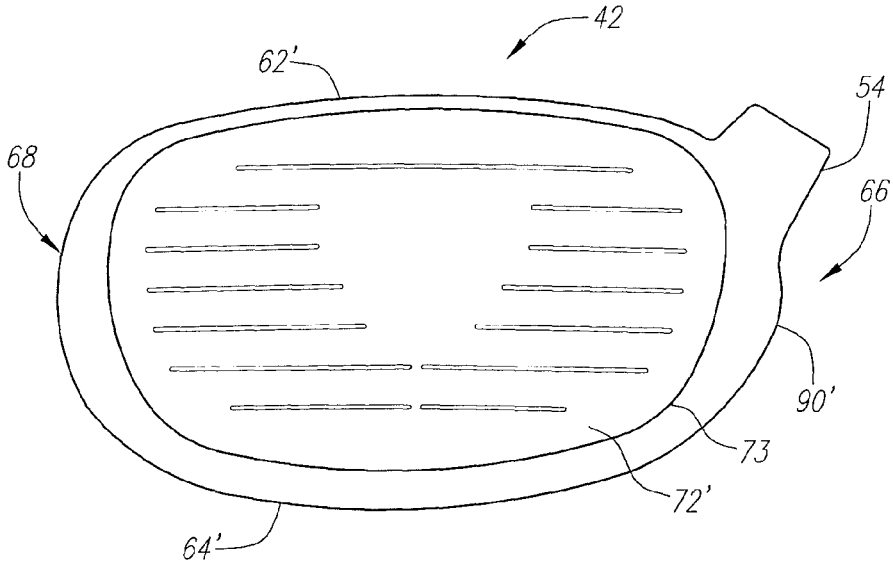
FIG. 2 is a front view of a golf club head of the present invention.
Figure 3:
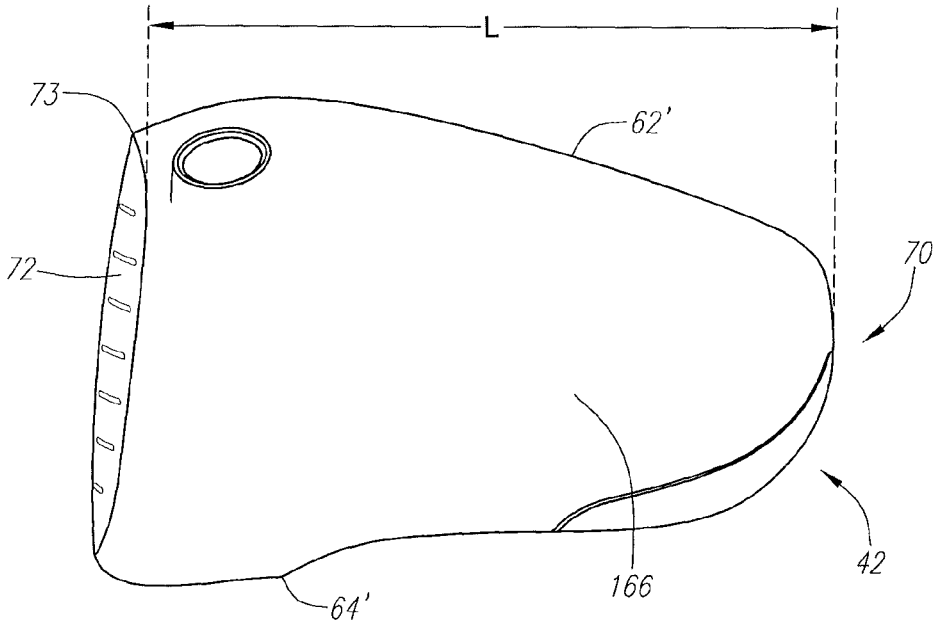
FIG. 3 is a heel-side view of a golf club head of the present invention illustrating the length, "L" of the golf club head from a striking plate of the golf club head to an aft end of the golf club head.
Figure 4:
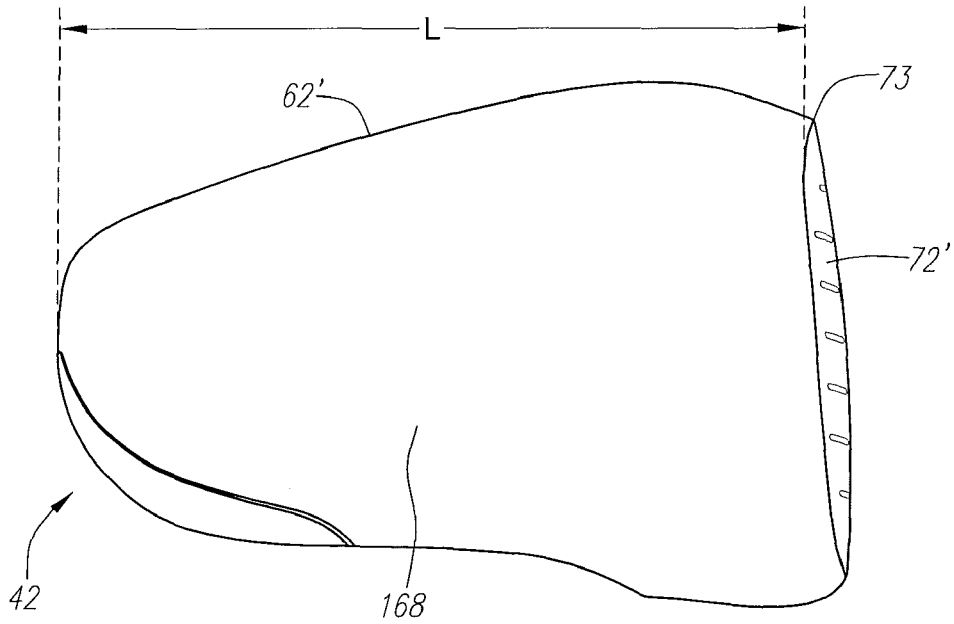
FIG. 4 is a toe-side view of a golf club head of the present invention illustrating the length, "L" of the golf club head from a striking plate of the golf club head to an aft end of the golf club head.
Figure 5:
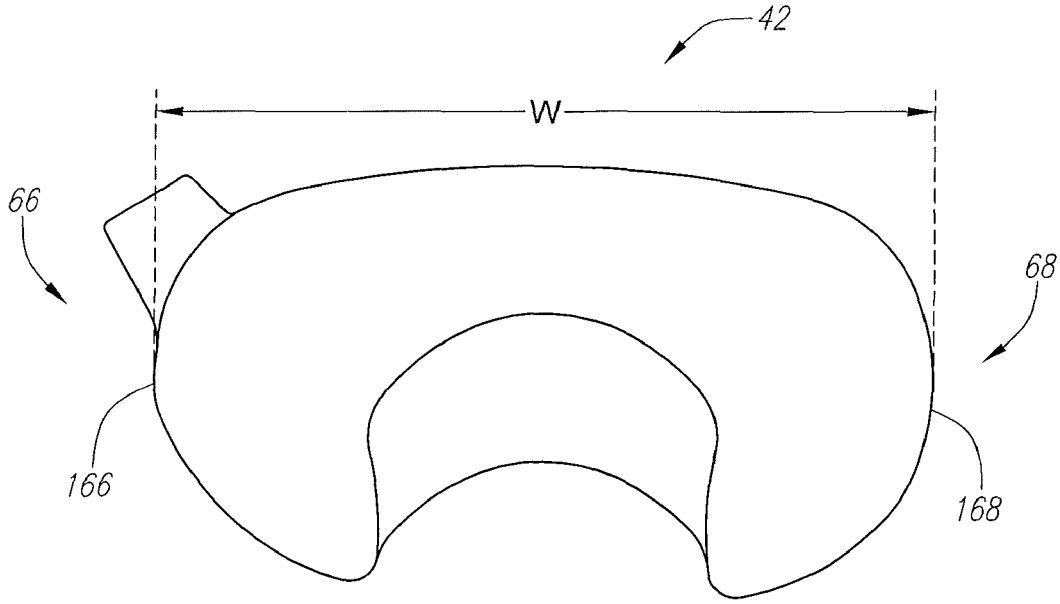
FIG. 5 is a rear view of a golf club head of the present invention illustrating the width, "W" of the golf club head from a heel end of the golf club head to a toe end of the golf club head, and illustrating the deep aft-cavity of the golf club head.
Figure 6:
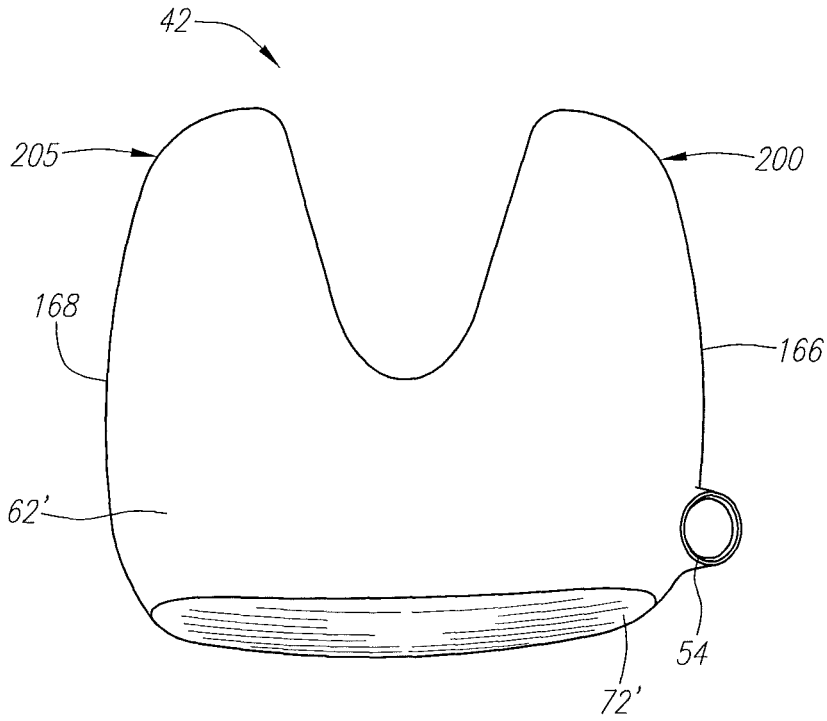
FIG. 6 is a top plan view of a golf club head of the present invention illustrating the deep aft-cavity of the golf club head.
Figure 7:
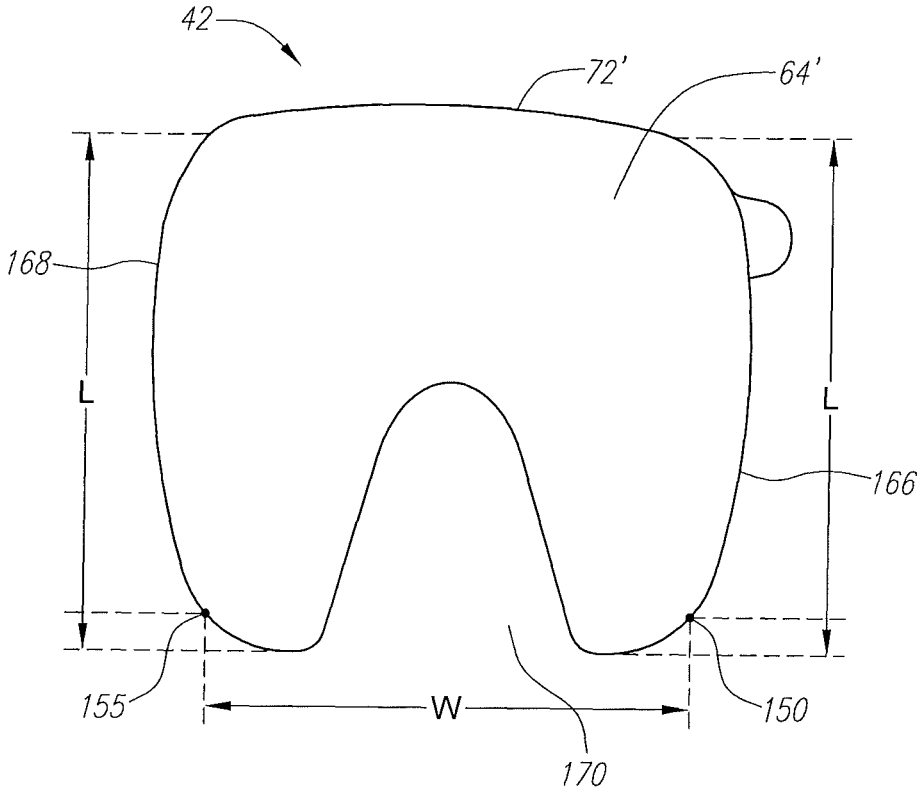
FIG. 7 is a bottom plan view of a golf club head of the present invention illustrating the width, "$W_1$" of the aft-end of the golf club head from a first deflection point of a transition from a heel end to aft-end of the golf club head to a second deflection point of a transition from a toe end to an aft-end of the golf club head, and illustrating the length, "L" of the golf club head from a striking plate of the golf club head to an aft end of the golf club head.
Figure 8:
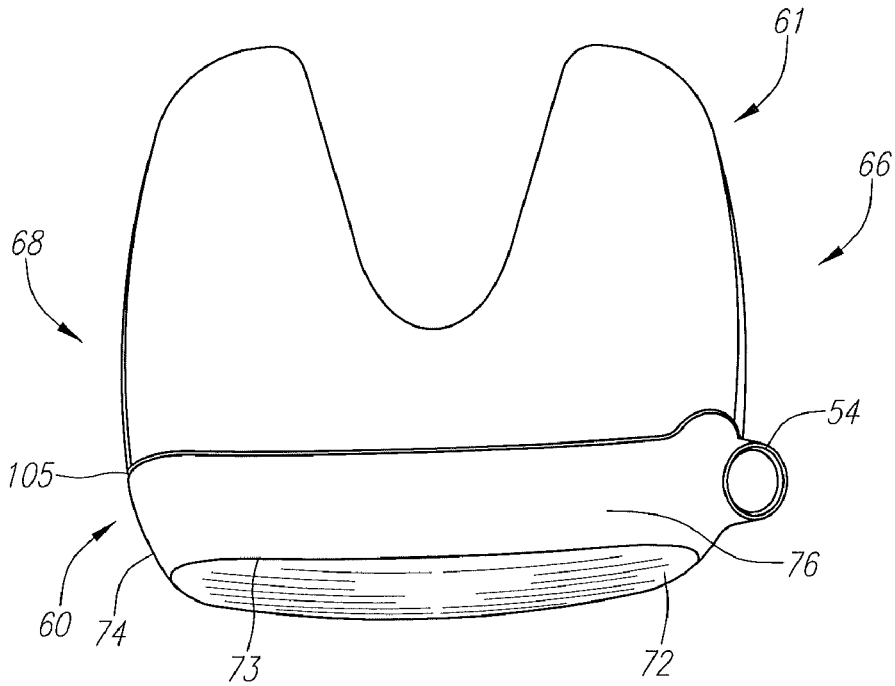
FIG. 8 is a top plan view of an alternative embodiment of a golf club head of the present invention illustrating a golf club head with a face component and a deep aft-cavity if an aft-body of the golf club head.
Figure 9:
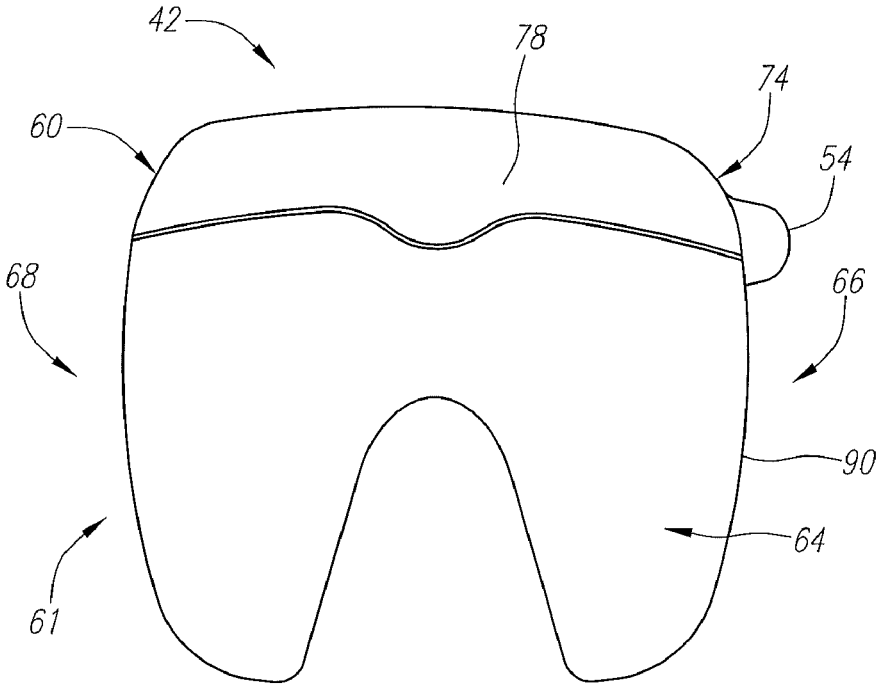
FIG. 9 is a bottom plan view of an alternative embodiment of a golf club head of the present invention illustrating a golf club head with a face component and a deep aft-cavity if an aft-body of the golf club head.
Figure 10:
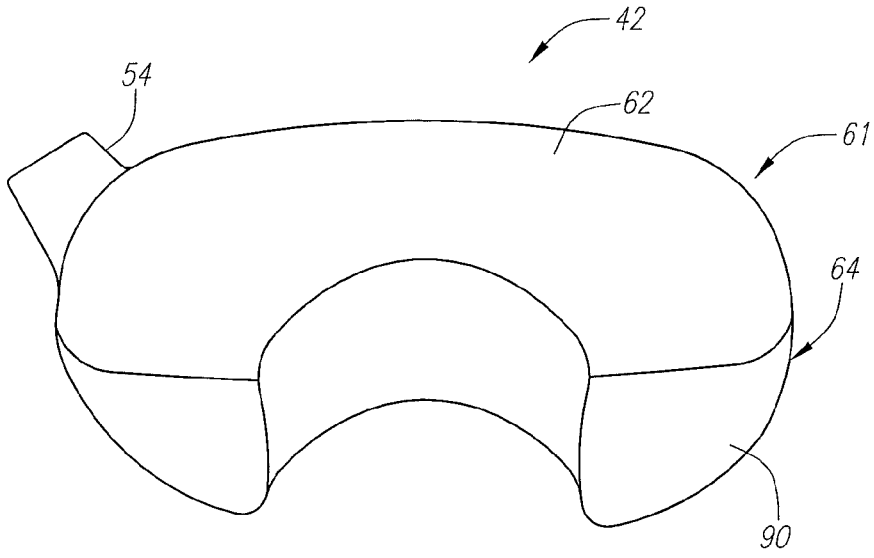
FIG. 10 is a rear-plan view of a golf club head illustrating a deep aft-cavity.
Figure 13:
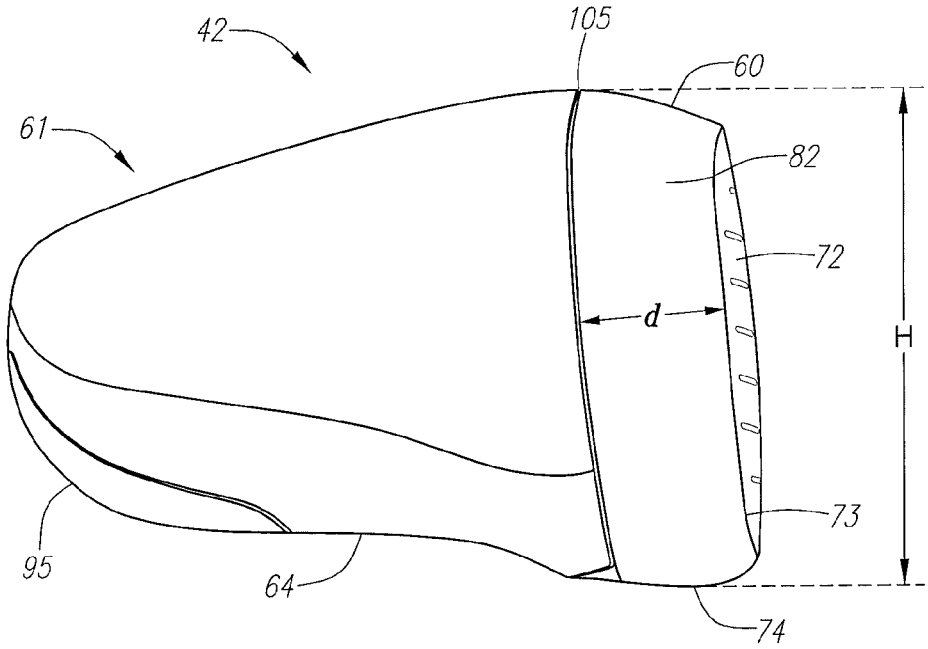
FIG. 13 is a toe-side view of a golf club head of the present invention illustrating a height, "H", of the golf club head from a lowest extent of a sole to a highest extent of a crown.
Figure 11:
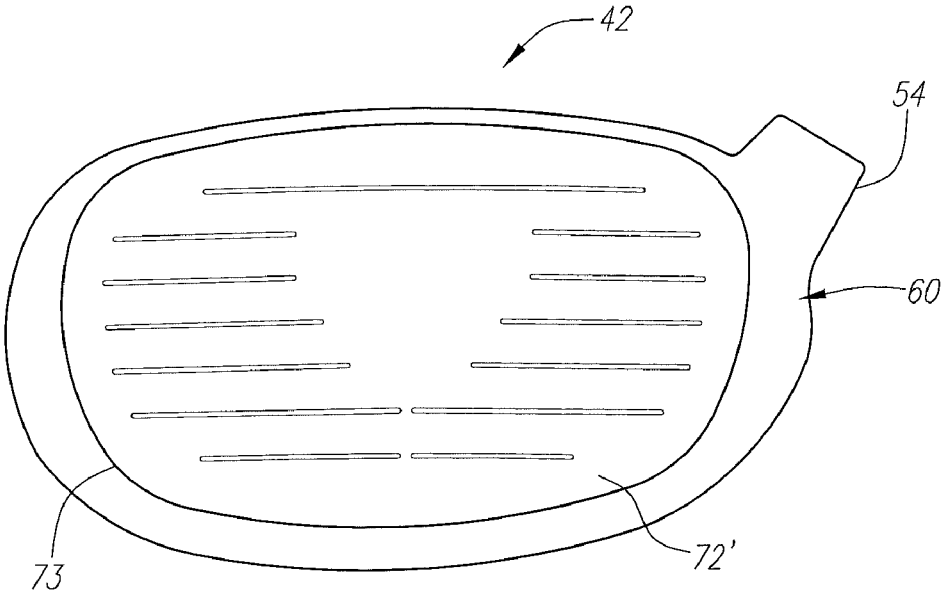
FIG. 11 is a front view of a golf club head of the embodiment of FIG. 8.
Figure 12:
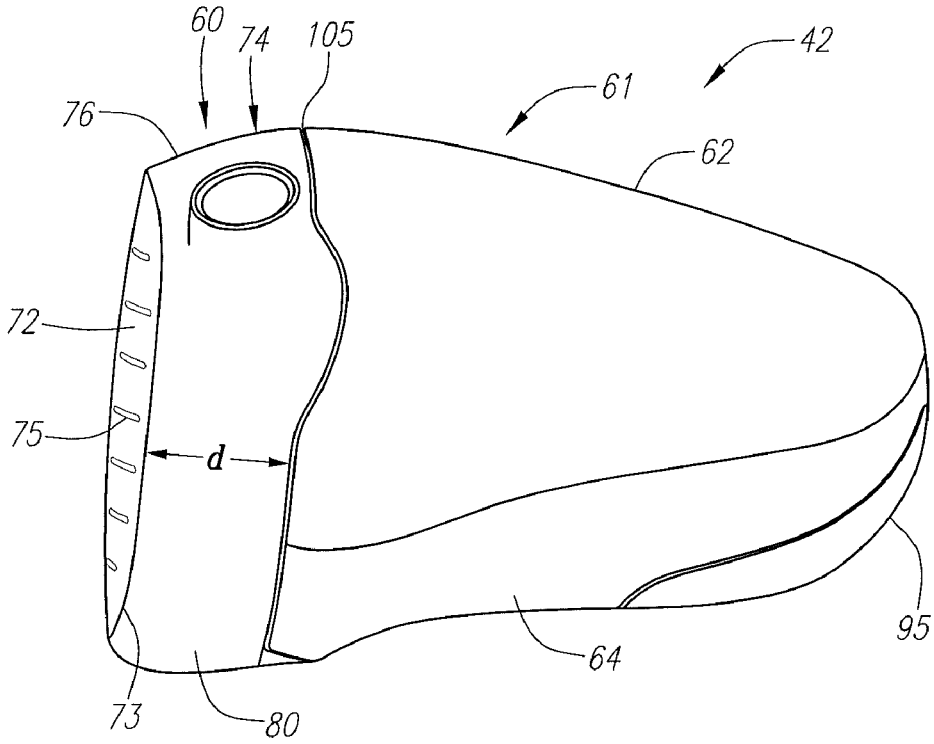
FIG. 12 is a heel-side view of a golf club head of the embodiment of FIG. 8.
Figure 14:
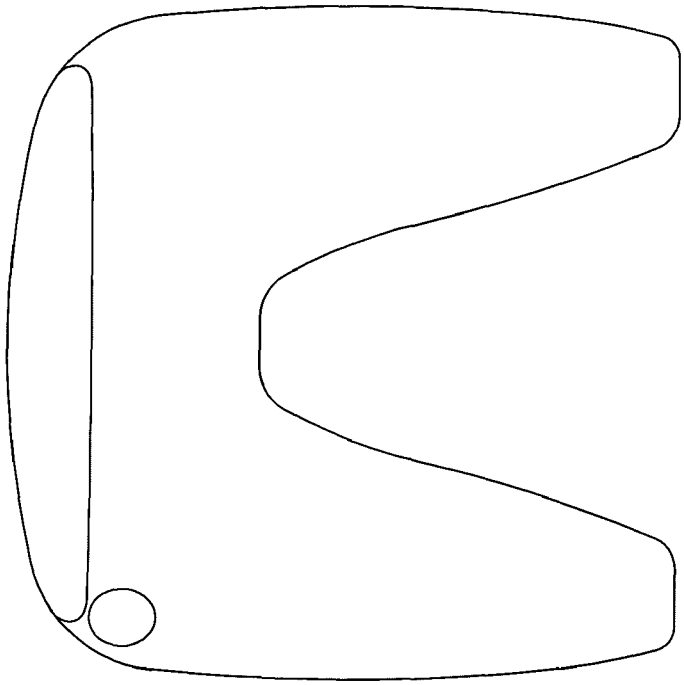
FIG. 14 is a top plan view of an alternative embodiment of a golf club head of the present invention.
Figure 15:
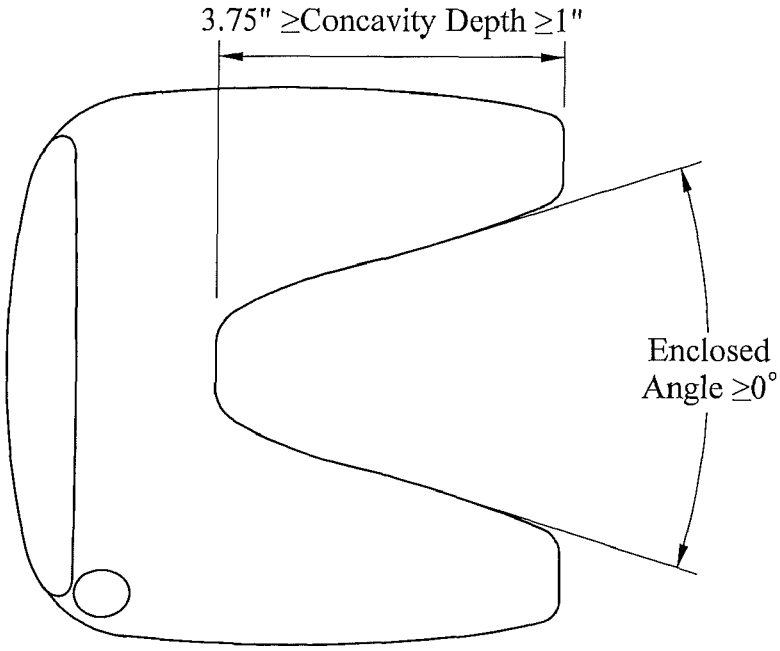
FIG. 15 is a top plan view of a golf club head of the present invention illustrating a preferred angle of a deep aft-cavity of a golf club head and a preferred depth of a deep aft-cavity of a golf club head of the present invention.
Figure 16:
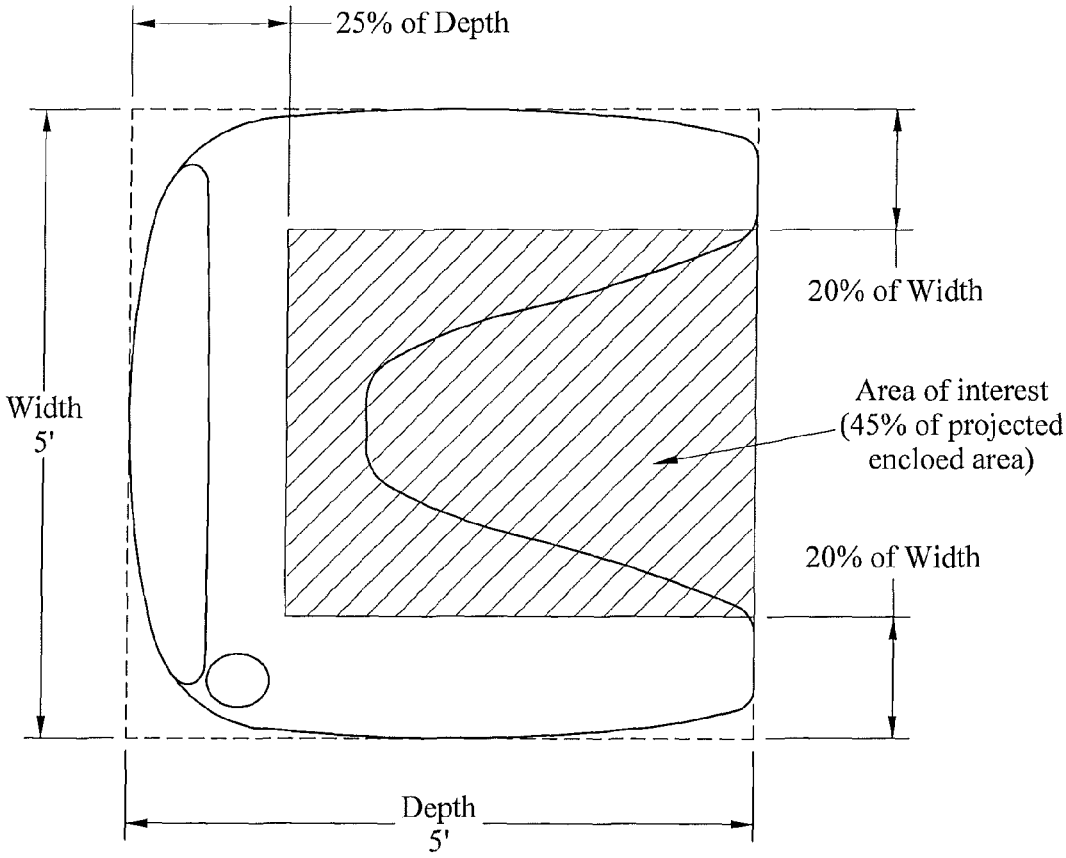
FIG. 16 is a top plan view of a golf club head of the present invention illustrating an area of interest and a preferred 20% width distance from each side and 25% depth distance from a striking plate which defines the area of interest.
Figure 17:
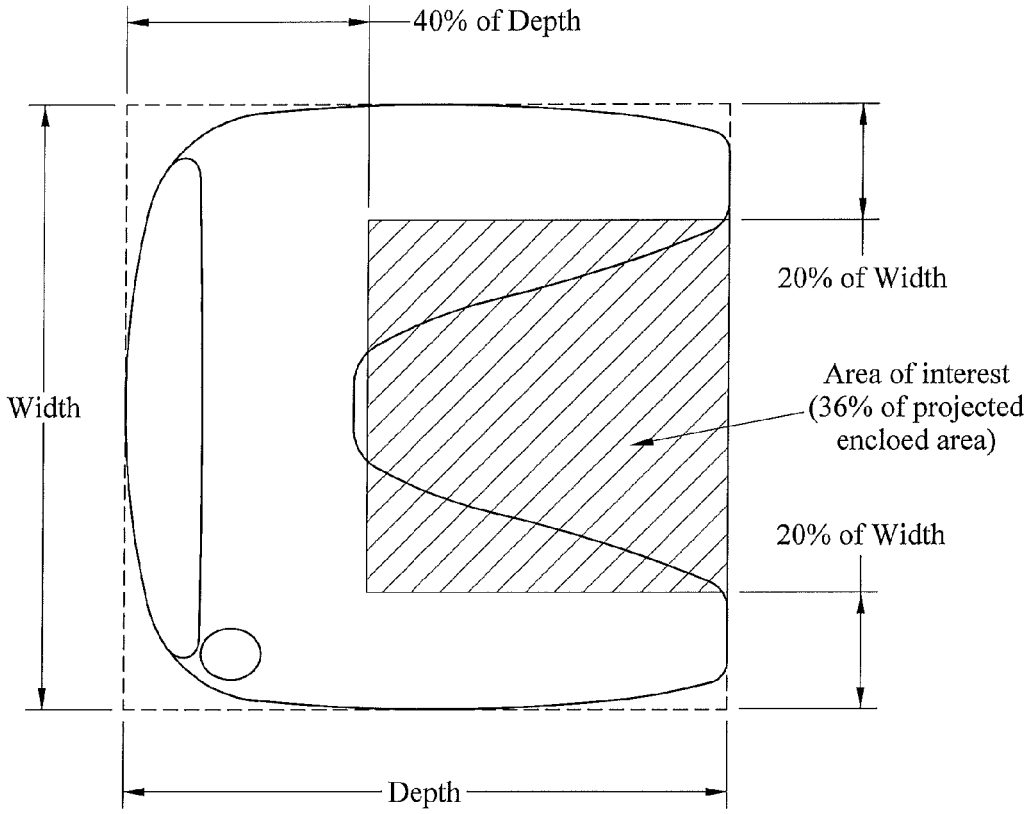
FIG. 17 is a top plan view of a golf club head of the present invention illustrating an alternative area of interest and a preferred 20% width distance from each side and an alternative 40% depth distance from a striking plate which defines the area of interest.
Figure 18:
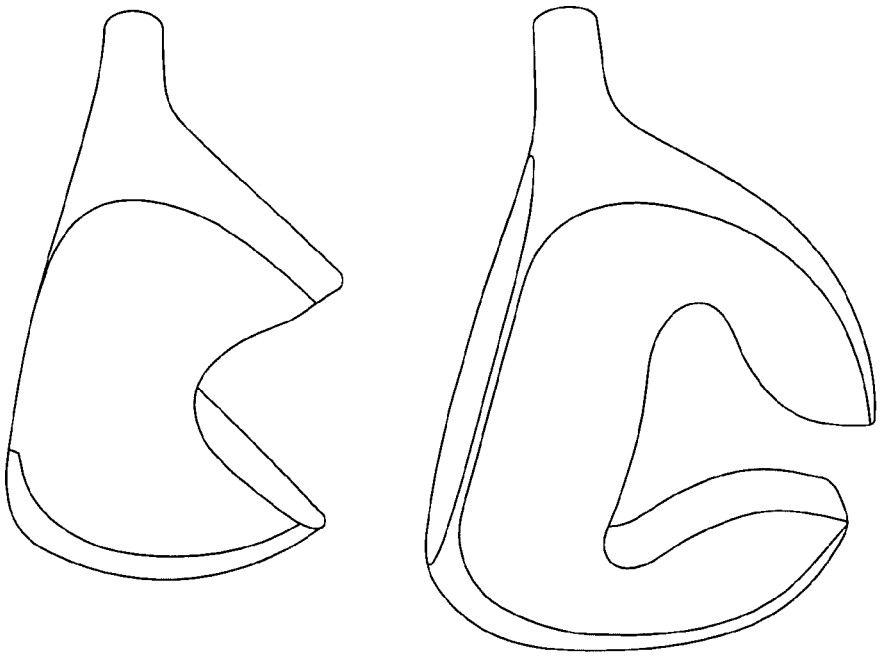
FIG. 18 (Prior Art)
FIG. 18 illustrates two golf clubs of the prior art.
Figure 19:
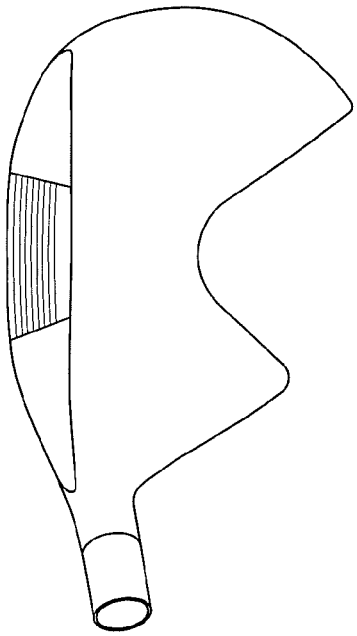
FIG. 19 (Prior Art)
FIG. 19 is a top plan view of a golf club of the prior art.
Figure 20:
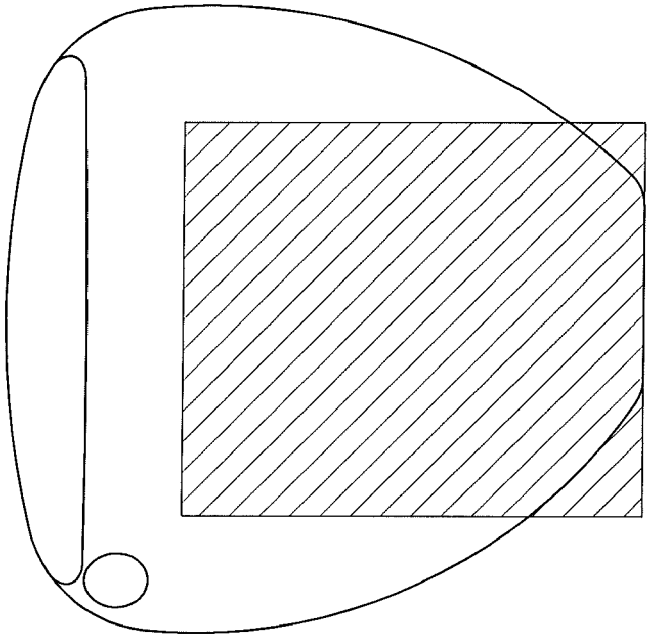
FIG. 20 (Prior Art)
FIG. 20 is a top plan view of a conventional golf club head illustrating the area of interest.
Figure 21:
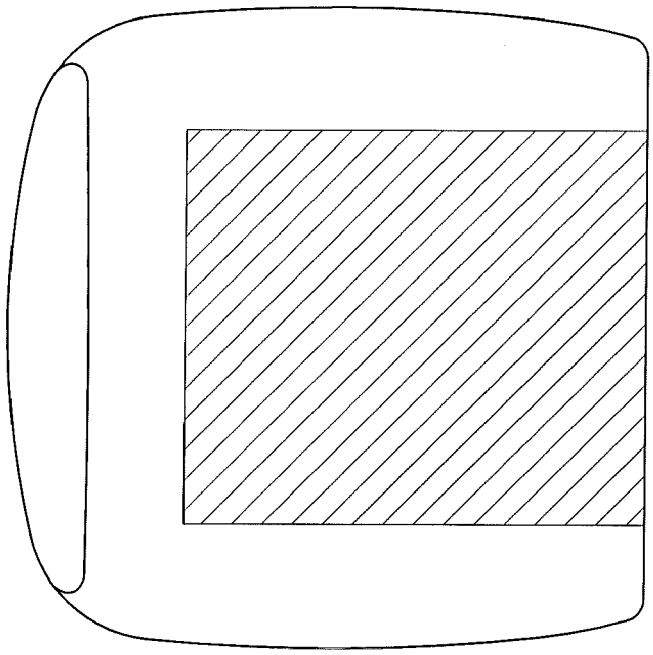
FIG. 21 (Prior Art)
FIG. 21 is a top plan view of a "square" golf club head illustrating the area of interest.

Shown in FIG. 1A, engaging the club head 42 is a shaft 48 that has a grip 50 at a butt end 52 of the shaft 48 and is inserted into a hosel 54 of the club head 42 at a tip end 56 of the shaft 48.

The golf club head 42 preferably has a distance, "L", from a furthest forward extent of the striking plate 72 to a furthest rearward extent of the golf club head 42 that preferably ranges from 2.00 to 5.00 inches, more preferably from 3.0 to 5.0 inches, and most preferably from 4.0 to 5.0 inches.

The body has a generally C-shape. More specifically, the body preferably has a front elongated section, a heel end arm and a toe end arm. The front elongated section has a rear wall the heel end arm has a rear wall, and the toe end arm has a rear wall. A description of a C-shaped golf club head is disclosed in U.S. patent application Ser. No. 11/954,422, filed on Dec. 12, 2007, which is hereby incorporated by reference in its entirety.

In a preferred embodiment, the club head 42 is generally composed of two components, a face component, and an aft-body such as disclosed in U.S. Pat. No. 6,758,763 for a Multiple Material Golf Club Head, which is hereby incorporated by reference in its entirety.

The face component is generally composed of a single piece of metal, and is preferably composed of a forged metal material. More preferably, the forged metal material is a forged titanium material. Such titanium materials include pure titanium and titanium alloys such as 6-4 titanium alloy, SP-700 titanium alloy (available from Nippon Steel of Tokyo, Japan), DAT 55G titanium alloy available from Diado Steel of Tokyo, Japan, Ti 10-2-3 Beta-C titanium alloy available from RTI International Metals of Ohio, and the like. Other metals for the face component include stainless steel, other high strength steel alloy metals and amorphous metals. Alternatively, the face component 60 is manufactured through casting, forming, machining, powdered metal forming, metal-injection-molding, electro chemical milling, and the like.

The face component generally includes the striking plate or front wall 72 and a return portion extending laterally inward from a perimeter of the striking plate 72. The striking plate 72 typically has a plurality of scorelines thereon. The striking plate 72 preferably has a thickness ranging from 0.010 inch to 0.250 inch, and the return portion preferably has a thickness ranging from 0.010 inch to 0.250 inch. The return portion preferably extends a distance ranging from 0.25 inch to 1.5 inches from the perimeter of the striking plate portion.

In a preferred embodiment, the return portion generally includes an upper lateral section, a lower lateral section, a heel lateral section and a toe lateral section. Thus, the return preferably encircles the striking plate 72 a full 360 degrees. However, those skilled in the pertinent art will recognize that the return portion may only encompass a partial section of the striking plate 72, such as 270 degrees or 180 degrees, and may also be discontinuous.

The aft-body is preferably composed of a non-metal material, preferably a composite material such as continuous fiber pre-preg material (including thermosetting materials or a thermoplastic materials for the resin). Other materials for the aft-body 61 include other thermosetting materials or other thermoplastic materials such as injectable plastics. Alternatively, the aft-body is composed of low-density metal materials, such as magnesium or aluminum. Exemplary magnesium alloys are available from Phillips Plastics Corporation under the brands AZ-91-D (nominal composition of magnesium with aluminum, zinc and manganese), AM-60-B (nominal composition of magnesium with aluminum and manganese) and AM-50-A (nominal composition of magnesium with aluminum and manganese). The aft-body is preferably manufactured through metal-injection-molding. Alternatively, the aft-body is manufactured through casting, forming, machining, powdered metal forming, electro chemical milling, and the like.

The aft-body is preferably manufactured through bladder-molding, resin transfer molding, resin infusion, injection molding, compression molding, or a similar process. In a preferred process, the face component, with an adhesive on the interior surface of the return portion, is placed within a mold with a preform of the aft-body for bladder molding. Such adhesives include thermosetting adhesives in a liquid or a film medium. A preferred adhesive is a two part liquid epoxy sold by 3M of Minneapolis Minn. under the brand names DP420NS and DP460NS. Other alternative adhesives include modified acrylic liquid adhesives such as DP810NS, also sold by the 3M company. Alternatively, foam tapes such as Hysol Synspan may be utilized with the present invention. A bladder is placed within the hollow interior of the preform and face component 60, and is pressurized within the mold, which is also subject to heating. The co-molding process secures the aft-body to the face component. Alternatively, the aft-body is bonded to the face component using an adhesive, or mechanically secured to the return portion.

In a preferred embodiment, the aft-body is composed of a plurality of plies of pre-preg, typically six or seven plies, such as disclosed in U.S. Pat. No. 6,248,025, entitled Composite Golf Head And Method Of Manufacturing, which is hereby incorporated by reference in its entirety.

The hosel is preferably at least partially disposed within the hollow interior of the club head 42, and is preferably located as a part of the face component. The hosel is preferably composed of a similar material to the face component, and is preferably secured to the face component through welding or the like. Alternatively, the hosel may be formed with the formation of the face component.

In a preferred embodiment, a weight member 122 is preferably positioned on the rear end 70 of the body 43 to increase the moment of inertia of the club head 42, to influence the center of gravity, and/or influence other inherent properties of the golf club head 42. The weight member 122 is preferably composed of tungsten loaded film, tungsten doped polymers, or similar weighting mechanisms such as described in U.S. Pat. No. 6,386,990, entitled A Composite Golf Club Head With An Integral Weight Strip, and hereby incorporated by reference in its entirety. Those skilled in the pertinent art will recognize that other high density materials, such as lead-free pewter, may be utilized as an optional weight without departing from the scope and spirit of the present invention.

In a preferred embodiment, the weight member 122 has a mass ranging from 5 grams to 50 grams, more preferably from 10 grams to 30 grams, and most preferably from 15 grams to 25 grams. The weight member 122 is preferably composed of a material that has a density ranging from 5 grams per cubic centimeters to 20 grams per cubic centimeters, more preferably from 7 grams per cubic centimeters to 12 grams per cubic centimeters.

The weight member 122 is preferably composed of a polymer material integrated with a metal material. The metal material is preferably selected from copper, tungsten, steel, aluminum, tin, silver, gold, platinum, or the like. A preferred metal is tungsten due to its high density. The polymer material is a thermoplastic or thermosetting polymer material. A preferred polymer material is polyurethane, epoxy, nylon, polyester, or similar materials. A most preferred polymer material is a thermoplastic polyurethane. A preferred weight member 122 is an injection molded thermoplastic polyurethane integrated with tungsten to have a density of 8.0 grams per cubic centimeters. In an alternative embodiment, the weight member 122 is composed of from 50 to 95 volume percent polyurethane and from 50 to 5 volume percent tungsten. Also, in an alternative embodiment, the weight member 122 is composed of from 10 to 25 weight percent polyurethane and from 90 to 75 weight percent tungsten. The placement of the weight member 122 allows for the moment of inertia of the golf club head 42 to be optimized.

The face component has a striking plate 72 with varying thickness. In a preferred embodiment, the striking plate 72 has a varying thickness such as described in U.S. Pat. No. 7,448,960, for a Golf Club Head With Variable Face Thickness, which pertinent parts are hereby incorporated by reference. Other alternative embodiments of the thickness of the striking plate 72 are disclosed in U.S. Pat. No. 6,398,666, for a Golf Club Striking Plate With Variable Thickness, U.S. Pat. No. 6,471,603, for a Contoured Golf Club Face and U.S. Pat. No. 6,368,234, for a Golf Club Striking Plate Having Elliptical Regions Of Thickness, which are all owned by Callaway Golf Company and which pertinent parts are hereby incorporated by reference. Alternatively, the striking plate 72 has a uniform thickness.

As mentioned previously, the face component is preferably forged from a rod of metal material. One preferred forging process for manufacturing the face component is set forth in U.S. Pat. No. 6,440,011, entitled Method For Processing A Striking Plate For A Golf Club Head, and hereby incorporated by reference in its entirety. Alternatively, the face component is cast from molten metal in a method such as the well-known lost-wax casting method. The metal for forging or casting is preferably titanium or a titanium alloy such as 6-4 titanium alloy, alpha-beta titanium alloy or beta titanium alloy for forging, and 6-4 titanium for casting.

Additional methods for manufacturing the face component include forming the face component from a flat sheet of metal, super-plastic forming the face component from a flat sheet of metal, machining the face component from a solid block of metal, electrochemical milling the face from a forged pre-form, and like manufacturing methods. Yet further methods include diffusion bonding titanium sheets to yield a variable face thickness face and then superplastic forming.

Alternatively, the face component is composed of an amorphous metal material such as disclosed in U.S. Pat. No. 6,471,604, and is hereby incorporated by reference in its entirety.

In an alternative embodiment of the golf club head 42, the body 43 has a front wall with an opening in which a striking plate 72 is preferably disposed within the opening. The body 43 is preferably composed of a non-metal material, preferably a composite material such as a continuous fiber pre-preg material (including thermosetting materials or thermoplastic materials for the resin). Other materials for the body 43 include other thermosetting materials or other thermoplastic materials such as injectable plastics. Further, other materials for the body 43 include magnesium alloys, aluminum alloys, magnesium, aluminum or other low density metals. The body 43 is preferably manufactured through bladder-molding, resin transfer molding, resin infusion, injection molding, compression molding, or a similar process.

The striking plate insert 72 is attached to the body 43 over the opening of the front wall of the body 43. The striking plate insert 72 is preferably composed of a formed metal material. Alternatively the striking plate insert 72 is composed of a machined metal material, a forged metal material, a cast metal material or the like. The striking plate insert 72 preferably is composed of a formed titanium or steel material. A preferred material is steel 4340, which is heat treated and then coated with a titanium nitride. Titanium materials useful for the striking plate insert 40 include pure titanium and titanium alloys such as 6-4 titanium alloy, SP-700 titanium alloy (available from Nippon Steel of Tokyo, Japan), DAT 55G titanium alloy available from Diado Steel of Tokyo, Japan, Ti 10-2-3 Beta-C titanium alloy available from RTI International Metals of Ohio, and the like. Other metals for the striking plate insert 40 include other high strength steel alloy metals and amorphous metals. Such steel materials include 17-4PH, Custom 450, 455, 465 and 465+ stainless steels, AERMET 100 and AERMET 310 alloy steels, all available from Carpenter Specialty Alloys, of Pennsylvania, and C35 maraging steels available from Allvac of North Carolina. Such amorphous metals include beryllium based alloys such as disclosed in U.S. Pat. No. 5,288,344, which pertinent parts are hereby incorporated by reference, quinary metallic glass alloys such as disclosed in U.S. Pat. No. 5,735,975, which pertinent parts are hereby incorporated by reference, and ternary alloys as disclosed in *Calculations of Amorphous-Forming Composition Range For Ternary Alloy Systems And Analyses Of Stabilization Of Amorphous Phase And Amorphous-Forming Ability, Takeuchi and Inoue*, Materials Transactions, Vol. 42, No. 7, p 1435-1444 (2001), which pertinent parts are hereby incorporated by reference.

The striking plate 72 is preferably co-molded with a body 43 or press-fitted into the opening subsequent to fabrication of the body 43. In another attachment process, the body 43 is first bladder molded and then the striking plate 72 is bonded to a recessed portion of the front wall using an adhesive. The adhesive is placed on the exterior surface of the recessed portion. Such adhesives include thermosetting adhesives in a liquid or a film medium. A preferred adhesive is a two part liquid epoxy sold by 3M of Minneapolis Minn. under the brand names DP420NS and DP460NS. Other alternative adhesives include modified acrylic liquid adhesives such as DP810NS, also sold by the 3M company. Alternatively, foam tapes such as Hysol Synspan may be utilized with the present invention.

Yet in another embodiment of the golf club head 42, the body 43 is preferably composed of a metal material such as titanium, titanium alloy, or the like, and is most preferably composed of a cast titanium alloy material.

The body 43 is preferably cast from molten metal in a method such as the well-known lost-wax casting method. The metal for casting is preferably titanium or a titanium alloy such as 6-4 titanium alloy, alpha-beta titanium alloy or beta titanium alloy for forging, and 6-4 titanium for casting. Alternatively, the body 43 is composed of 17-4 steel alloy. Additional methods for manufacturing the body 43 include forming the body 43 from a flat sheet of metal, super-plastic forming the body 43 from a flat sheet of metal, machining the body 43 from a solid block of metal, electrochemical milling the body from a forged pre-form, casting the body using centrifugal casting, casting the body using levitation casting, and like manufacturing methods.

The golf club head 42 of this embodiment optionally has a front wall with an opening for placement of a striking plate 72 such as disclosed in U.S. Pat. No. 6,902,497 for A Golf Club Head With A Face Insert. The striking plate 72 preferably is composed of a formed titanium alloy material. Such titanium materials include titanium alloys such as 6-22-22 titanium alloy and Ti 10-2-3 alloy, Beta-C titanium alloy, all available from RTI International Metals of Ohio, SP-700 titanium alloy (available from Nippon Steel of Tokyo, Japan), DAT 55G titanium alloy available from Diado Steel of Tokyo, Japan, and like materials. The preferred material for the striking plate insert 72' is a heat treated 6-22-22 titanium alloy which is a titanium alloy composed by weight of titanium, 6% aluminum, 2% tin, 2% chromium, 2% molybdenum, 2% zirconium and 0.23% silicon. The titanium alloy will have an alpha phase in excess of 40% of the overall microstructure.

In yet another embodiment for the golf club head 42, the golf club head has a construction with a crown composed of plies of pre-preg material such as disclosed in U.S. Pat. No. 6,575,845, for a Multiple Material Golf Club Head, which pertinent parts are hereby incorporated by reference.

In yet another embodiment, the golf club head 42 has a shape as disclosed, and a construction with a body composed of plies of pre-preg material such as disclosed in U.S. Pat. No. 6,607,452, for a High Moment Of Inertia Composite Golf Club Head, which pertinent parts are hereby incorporated by reference.

In a preferred embodiment, the golf club head 42 has a high coefficient of restitution thereby enabling for greater distance of a golf ball hit with the golf club. The coefficient of restitution (also referred to herein as "COR") is determined by the following equation:

$$e = \frac{v_2 - v_1}{U_1 - U_2}$$

wherein $U_1$ is the club head velocity prior to impact; $U_2$ is the golf ball velocity prior to impact which is zero; $v_1$ is the club head velocity just after separation of the golf ball from the face of the club head; $v_2$ is the golf ball velocity just after separation of the golf ball from the face of the club head; and e is the coefficient of restitution between the golf ball and the club face.

The values of e are limited between zero and 1.0 for systems with no energy addition. The coefficient of restitution, e, for a material such as a soft clay or putty would be near zero, while for a perfectly elastic material, where no energy is lost as a result of deformation, the value of e would be 1.0. The present invention provides a club head having a coefficient of restitution ranging from 0.81 to 0.94, as measured under conventional test conditions.

The coefficient of restitution of the club head 42 under standard USGA test conditions with a given ball ranges from approximately 0.81 to 0.94, preferably ranges from 0.82 to 0.88 and is most preferably 0.83.

Additionally, the striking plate portion 72 of the face component 60 has a more rectangular face providing a greater aspect ratio. The aspect ratio as used herein is defined as the width, "W", of the face divided by the height, "H", of the face. In one preferred embodiment, the width W is 100 millimeters and the height H is 56 millimeters giving an aspect ratio of 1.8. The striking plate portion 72 of the present invention preferably has an aspect ratio that is greater than 1.8 for a club head having a volume greater than 420 cubic centimeters.

The face area of the striking plate portion 72 preferably ranges from 5.00 square inches to 10.0 square inches, more preferably from 7.0 square inches to 10.0 square inches, and most preferably from 8.0 square inches to 10.0 square inches.

The axes of inertia are designated X, Y and Z. The X-axis extends from the striking plate portion 72 through the center of gravity, CG, and to the rear of the golf club head 42. The Y-axis extends from the toe end 68 of the golf club head 42 through the center of gravity, CG, and to the heel end 66 of the golf club head 42. The Z-axis extends from the crown portion 62 through the center of gravity, CG, and through the sole portion 64.

As defined in *Golf Club Design, Fitting, Alteration & Repair,* 4th Edition, by Ralph Maltby, the center of gravity, or center of mass, of the golf club head is a point inside of the club head determined by the vertical intersection of two or more points where the club head balances when suspended. A more thorough explanation of this definition of the center of gravity is provided in *Golf Club Design, Fitting, Alteration & Repair.*

The center of gravity and the moment of inertia of a golf club head 42 are preferably measured using a test frame ($X^T$, $Y^T$, $Z^T$), and then transformed to a head frame ($X^H$, $Y^H$, $Z^H$). The center of gravity of a golf club head may be obtained using a center of gravity table having two weight scales thereon, as disclosed in U.S. Pat. No. 6,607,452, entitled High Moment Of Inertia Composite Golf Club, and hereby incorporated by reference in its entirety. If a shaft is present, it is removed and replaced with a hosel cube that has a multitude of faces normal to the axes of the golf club head. Given the weight of the golf club head, the scales allow one to determine the weight distribution of the golf club head when the golf club head is placed on both scales simultaneously and weighed along a particular direction, the X, Y or Z direction. Those skilled in the pertinent art will recognize other methods to determine the center of gravity and moments of inertia of a golf club head.

In general, the moment of inertia, Izz, about the Z axis for the golf club head 42 of the present invention will range from 4500 g-cm$^2$ to 6000 g-cm$^2$, preferably from 5000 g-cm$^2$ to 6000 g-cm$^2$, and most preferably greater than 5000 g-cm$^2$. The moment of inertia, Iyy, about the Y axis for the golf club head 42 of the present invention will range from 2000 g-cm$^2$ to 5000 g-cm$^2$, preferably from 2500 g-cm$^2$ to 4500 g-cm$^2$, and most preferably greater than 4000 g-cm$^2$. The moment of inertia, Ixx, about the X axis for the golf club head 42 of the present invention will range from 2000 g-cm$^2$ to 4000 g-cm$^2$, preferably from 2500 g-cm$^2$ to 3750 g-cm$^2$, and most preferably from 3000 g-cm$^2$ to 3500 g-cm$^2$.

In general, the golf club head 42 has products of inertia such as disclosed in U.S. Pat. No. 6,425,832, and is hereby incorporated by reference in its entirety. Preferably, each of the products of inertia, Ixy, Ixz and Iyz, of the golf club head 42 have an absolute value less than 100 grams-centimeter squared. Alternatively, at least two of the products of inertia, Ixy, Ixz or Iyz, of the golf club head 42 have an absolute value less than 100 grams-centimeter squared.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club head comprising:

a C-shaped body having a deep aft cavity having a length ranging from 1.0 inch to 3.75 inches rearward from a striking plate wall of the C-shaped body;

wherein the C-shaped body has a length ranging from 4.75 inches to 5.5 inches, a width of the front wall ranging from 4.75 inches to 5.5 inches and a height of the front wall ranging from 2.5 inches to 3.0 inches;

wherein an area of interest is located 20% of the width of the golf club head from each side of the golf club head and 40% of the length of the golf club head from the front wall, and the area of interest has less than 15% of the mass of the golf club head; and wherein the golf club head has a moment of inertia Iyy about the center of gravity greater than 4000 g-cm$^2$.

2. The golf club head according to claim 1 wherein the C-shaped body has a volume ranging from 450 cubic centimeters to 470 cubic centimeters.

3. The golf club head according to claim 1 wherein the C-shaped body is composed of a material selected from the group consisting of titanium, titanium alloy, steel, magnesium, magnesium alloy, aluminum, aluminum alloy, pre-preg material, thermoplastic polyurethane, and polycarbonate.

4. The golf club head according to claim 1 wherein the golf club head has a mass ranging from 185 grams to 225 grams.

5. The golf club head according to claim 1 wherein the golf club head has mass ranging from 195 grams to 215 grams.

6. The golf club head according to claim 1 wherein the golf club head has mass ranging from 190 grams to 220 grams.

7. The golf club head according to claim 1 wherein the golf club head has a moment of inertia Izz about the center of gravity ranging from 4000 g-cm$^2$ to 5000 g-cm$^2$.

8. The golf club head according to claim 1 wherein the golf club head has a moment of inertia Ixx about the center of gravity ranging from 2000 g-cm$^2$ to 4000 g-cm$^2$.

9. The golf club head according to claim 1 wherein the striking plate wall has variable face thickness.

10. A golf club head comprising:

a C-shaped body having a deep aft-cavity, the body having a front elongated section, a heel end arm extending rearward from the front elongated section, a toe arm extending rearward from the front elongated section;

wherein the golf club head has a mass ranging from 185 grams to 215 grams and a volume ranging from 450 cubic centimeters to 470 cubic centimeters;

wherein the body has a length ranging from 4.75 inches to 5.5 inches, a width of the front wall ranging from 4.75 inches to 5.5 inches and a height of the front wall ranging from 2.5 inches to 3.0 inches;

wherein an area of interest is located 20% of the width of the golf club head from each side of the golf club head and 40% of the length of the golf club head from the front wall, and the area of interest has less than 15% of the mass of the golf club head; and wherein the golf club head has a moment of inertia Iyy about the center of gravity greater than 4000 g-cm$^2$.

* * * * *